US007182697B2

(12) United States Patent
Zamora

(10) Patent No.: US 7,182,697 B2
(45) Date of Patent: Feb. 27, 2007

(54) HOLE-ALIGNING PUTTER

(76) Inventor: Ruben Zamora, 3969 33rd St., San Diego, CA (US) 92104

( * ) Notice: Subject to any disclaimer, the term of this patent is extended or adjusted under 35 U.S.C. 154(b) by 0 days.

(21) Appl. No.: 10/961,417

(22) Filed: Oct. 7, 2004

(65) Prior Publication Data

US 2006/0079343 A1 Apr. 13, 2006

(51) Int. Cl.
*A63B 69/36* (2006.01)

(52) U.S. Cl. ..... 473/251; 473/252

(58) Field of Classification Search ..... 473/236, 473/242, 251–254, 341, 331; D21/736–746
See application file for complete search history.

(56) References Cited

U.S. PATENT DOCUMENTS 3,954,265 A * 5/1976 Taylor ..... 473/252
3,954,270 A * 5/1976 Cook ..... 473/252
D240,751 S * 7/1976 Taylor ..... D21/734
4,484,746 A * 11/1984 Brill ..... 473/251
4,530,505 A * 7/1985 Stuff ..... 473/250
4,741,535 A * 5/1988 Leonhardt ..... 473/252
4,834,387 A * 5/1989 Waites et al. ..... 473/252
4,913,438 A * 4/1990 Anderson ..... 473/253
5,282,622 A 2/1994 Evans
5,390,919 A * 2/1995 Stubbs et al. ..... 473/246
5,746,664 A 5/1998 Reynolds, Jr.
5,967,902 A * 10/1999 Greenquist et al. ..... 473/253
5,997,409 A * 12/1999 Mattson ..... 473/244
6,176,791 B1 * 1/2001 Wright ..... 473/252
6,692,372 B1 * 2/2004 Colucci ..... 473/251
6,739,980 B2 * 5/2004 Scott et al. ..... 473/200

* cited by examiner

*Primary Examiner*—Sebastiano Passaniti
(74) *Attorney, Agent, or Firm*—Steins & Associates, P.C.

(57) ABSTRACT

A Hole-aligning Putter is disclosed. The putter defines a center alignment mark on the face and top surface of the club head. The putter further displays second and third alignment marks straddling the first (center) alignment mark in spaced relation at a distance of somewhat less than the diameter of a conventional golf ball. Finally, the putter further displays fourth and fifth alignment marks straddling the first (center) alignment mark in spaced relation at a distance equal to the diameter of the cup. The result of the visually apparent difference in the distance between the fourth and fifth marks and that of the second and third marks inspires additional confidence in the golfer, thereby improving his or her golf game.

13 Claims, 5 Drawing Sheets

HOLE-ALIGNING PUTTER

BACKGROUND OF THE INVENTION

1. Field of the Invention

This invention relates generally to golfing aides and, more specifically, to a Hole-aligning Putter.

2. Description of Related Art

Golf and related training aides are now available in an infinite variety and to cure any number of problems with a person's game, and/or to simply improve a person's proficiency. One particular area of focus has historically been the putting game, because many golfers believe that games or won or lost on the putting green. In addressing the problems associated with putting, the golf equipment industry has made many different products available, including special clubs, clothing, aiming tools, and many others.

Virtually every putter made includes one or more alignment lines or indicia inscribed or otherwise displayed on them. These marks are provided to assist the golfer in aligning the club face with the ball and with the cup. Other devices even provide assistance with the golfer's stance or address of the ball. One prior putter having such alignment marks is shown in FIG. 1.

FIG. 1 is a top view of a prior art putter. The putter 10 of FIG. 1 is the putter disclosed in Evans U.S. Pat. No. 5,282,622 known as the standing putter. The putter 10 has a club head 12 that is configured to provide the golfer with alignment assistance in aligning the ball with the cup. In fact, the head 12 has a first alignment mark 14A provided on the far left side of the head 12; a second alignment mark 14B provided on the far right hand side of the head 12, as well as third and fourth alignment marks 14C and 14D located near the center of the head 12. There is further a center alignment mark to aid the golfer in aligning the head to the ball itself.

The space between the third and the fourth alignment marks 14C and 14D is disclosed as the GB or the diameter of a golf ball 18. The distance between the first and second alignment marks 14A and 14B is disclosed as being the BDZ 16 or ball drop zone. The ball drop zone is defined by Evans as being that zone within which the ball will drop into the cup if the ball arrives at the cup within the zone. As shown here, the width of the ball drop zone 16 is the diameter of the cup profile 20 plus two times slightly less than the diameter of a ball profile 22. The idea being that if the ball arrives at the edge of the cup, but with the center of the ball over the edge of the cup, then the ball will drop into the cup.

The problem with the Evans putter 10 is that the ball drop zone 16 is simply too wide to provide the golfer with an accurate representation of his or her target. The inventor fears that if the golfer is seeking to position the ball over the lip of the cup, normal error will result in a ball not dropping into the cup and therefore a missed put. If we now turn to FIG. 2, we can examine yet another prior art putter.

FIG. 2 is a perspective view of another prior art putter. FIG. 2 depicts the prior golf club alignment aid known as the two ball head 11 made by Calloway Golf™. The two ball head 11 has a club head 13 defined by face 15 and a top surface 17. Top surface 17 has a first ball imagine 19 and a second ball image 21 cut into it in planer alignment with the alignment line 23. Generally speaking, the alignment line 23 is an imaginary line that extends perpendicular to the face 15, and is assumed to be the direction which a ball 25 will travel if it is struck with the face 15.

To use the two ball club 11, the user simply aligns the first and second ball images 19 and 21, respectively, with the actual ball 25 so that the alignment line 23 is created by connecting the centers of the two images 19 and 21 and the ball 25. By doing so, that inventor believes that the golfer is both aligning the center of the face horizontally with the ball 25, as well as aligning the club face 15 with the hole.

The two ball club head 11 has achieved a moderate level of success with amateur golfers. The problem with the two ball head 11 is that it fails to inspire in the golfer the confidence to align the ball with the cup. What is needed is an improved putter head design that provides the golfer with an alignment tool that does show the size difference between the cup and the ball 25 in order to inspire this confidence without inspiring the overconfidence believed to be expected using the Evans putter.

SUMMARY OF THE INVENTION

In light of the aforementioned problems associated with the prior games and devices, it is an object of the present invention to provide a Hole-aligning Putter. The putter should define a center alignment mark on the face and top surface of the club head. The putter should further display second and third alignment marks straddling the first (center) alignment mark in spaced relation at a distance of somewhat less than the diameter of a conventional golf ball. Finally, the putter should further display fourth and fifth alignment marks straddling the first (center) alignment mark in spaced relation at a distance equal to the diameter of the cup. The result of the difference in the distance between the fourth and fifth marks and that of the second and third marks should inspire additional confidence in the golfer, thereby improving his or her golf game.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Hole-aligning Putter.

Figure 1:
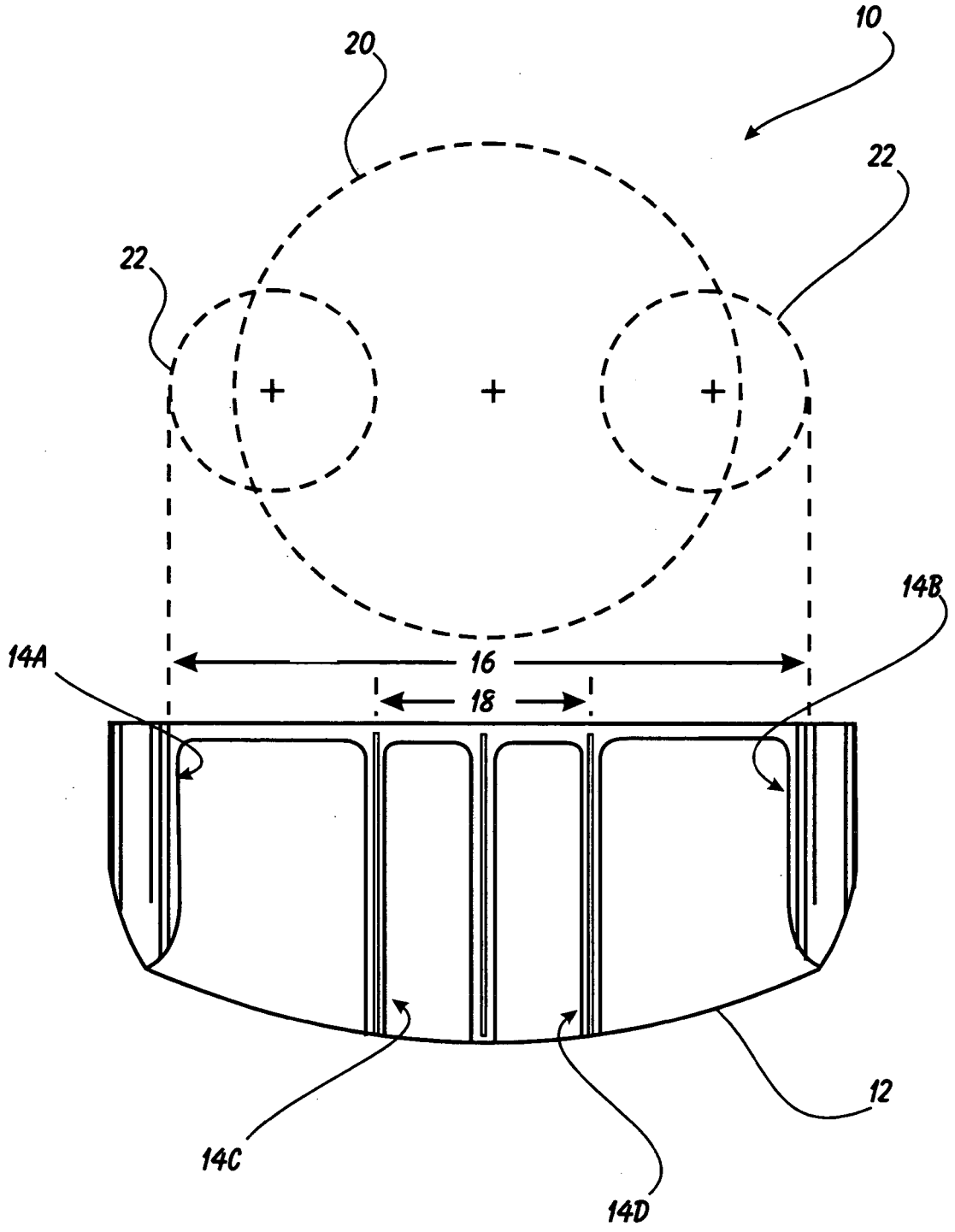
FIGURE 1 PRIOR ART
FIG. 1 is a top view of a prior art putter.
Figure 2:
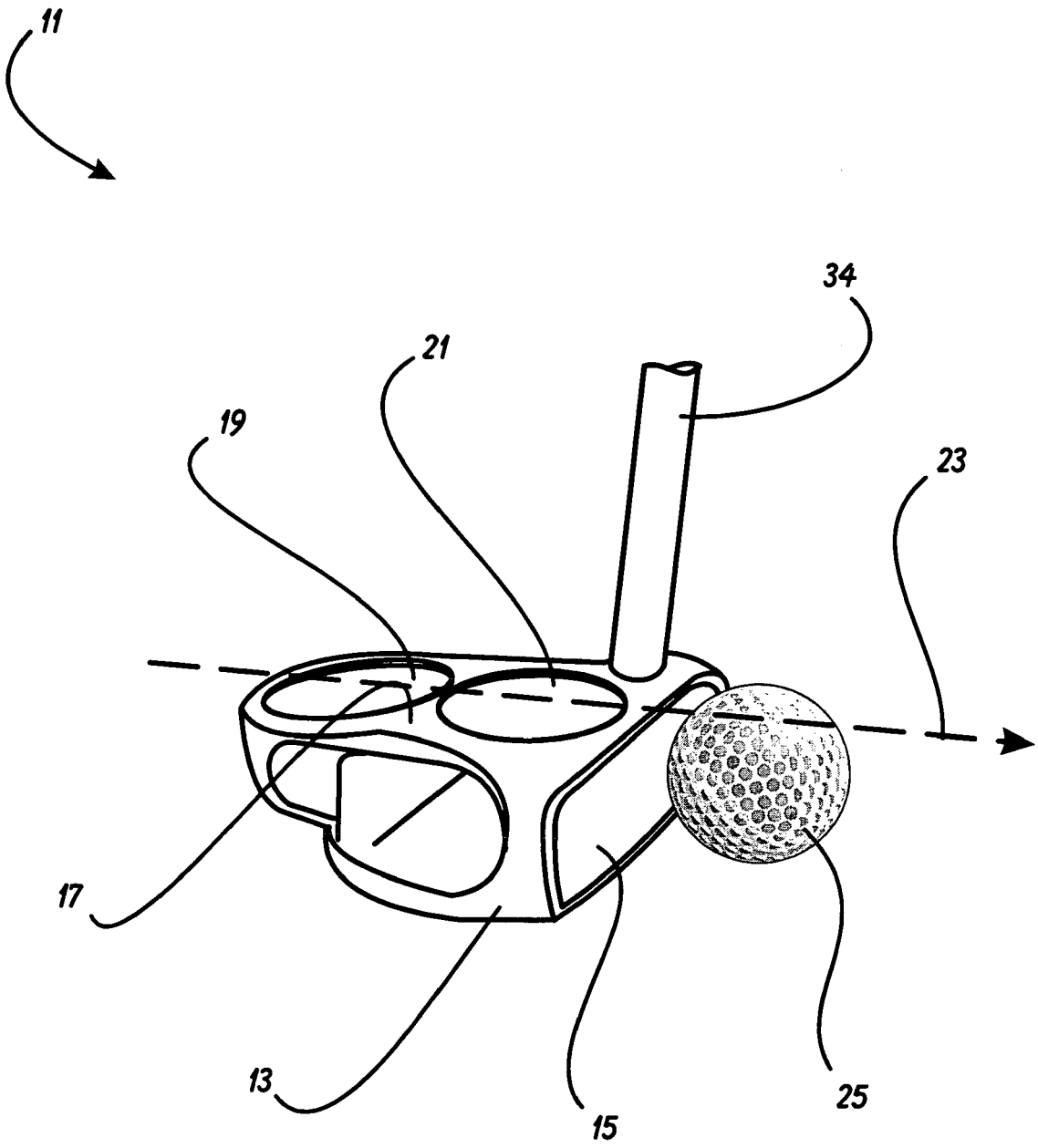
FIGURE 2 PRIOR ART
FIG. 2 is a perspective view of another prior art putter.
Figure 3:
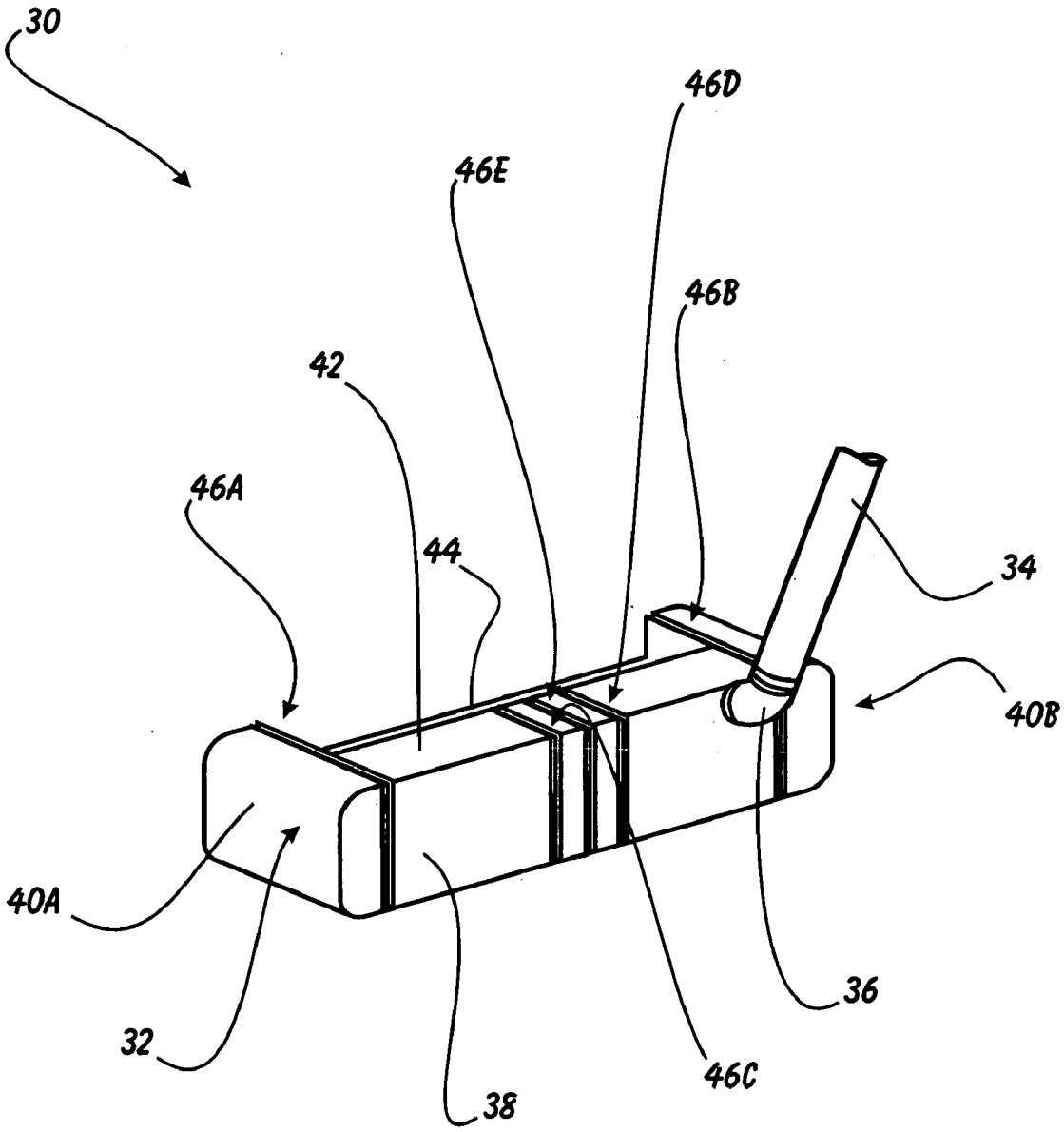
FIG. 3 is a perspective view of a preferred embodiment of the hole-aligning putter of the present invention.

The present invention can best be understood by initial consideration of FIG. 3. FIG. 3 is a perspective view of a preferred embodiment of the hole-aligning putter of the present invention. The hole-aligning putter 30 of the present invention comprises a club head 32 attachable to a shaft 34. The head 32 attaches to the shaft 34 at the shaft socket 36. The club head is defined by a face 38, a first end 40A, a second end 40B, a top surface 42 and a heel 44. The heel 44 may or may not be cut back to a lower level than the top surface 42, depending on the weighting desired by the golfer.

The head 32 is defined by a first alignment mark 46A and a second alignment mark 46B. There are further third and fourth alignment marks 46C and 46D and a center alignment mark 46E. As shown here, the alignment marks 46 extend from the top surface down onto the face 38. In other versions, one or more of these alignment marks 46 may only appear on the top surface 42 and not on the face 38. It would be clearer by review of FIG. 4 how the whole aligning putter 30 of this invention is distinct from the prior art.

Figure 4:
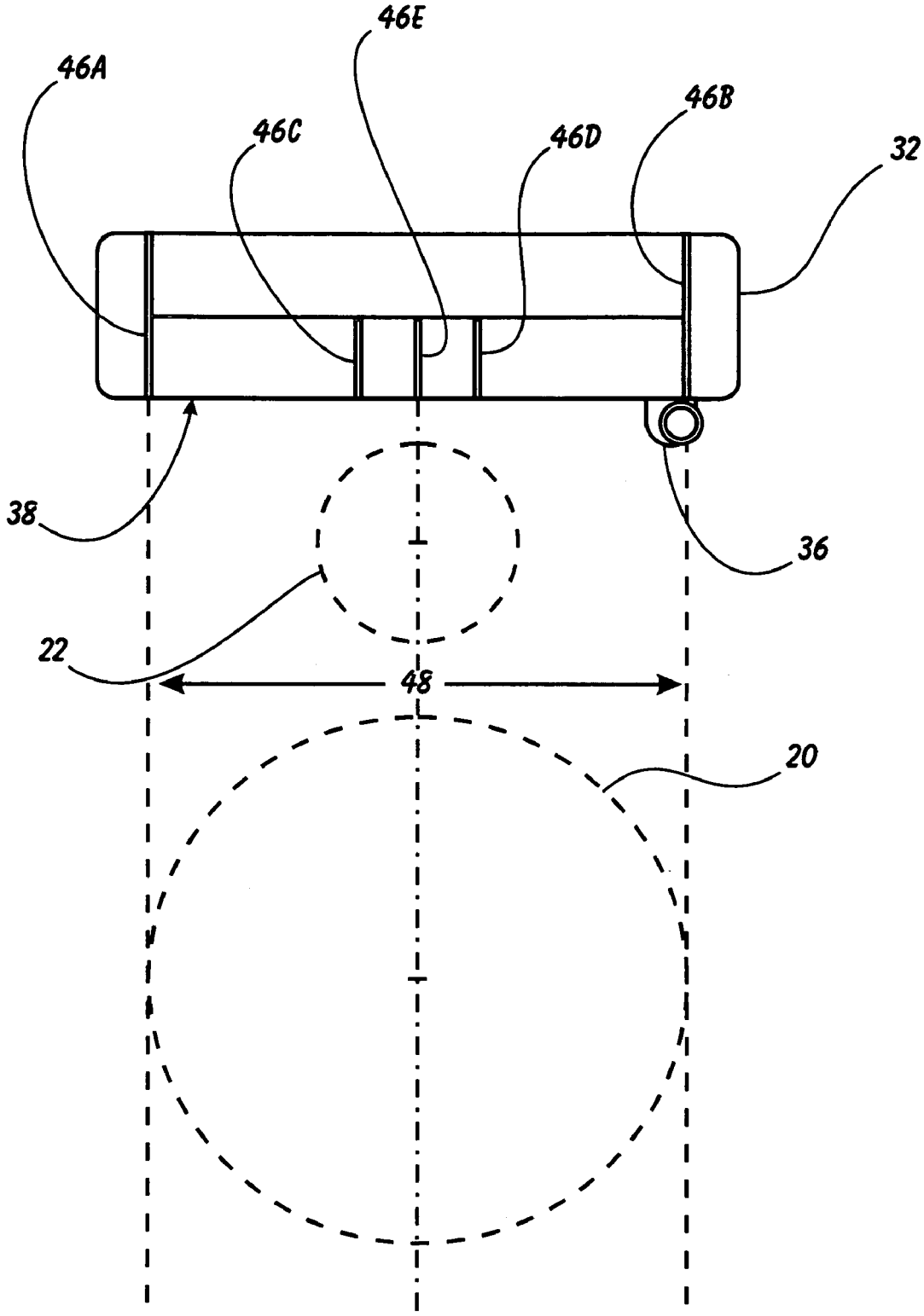
FIG. 4 is a top view of the putter of FIG. 3.

FIG. 4 is a top view of the putter of FIG. 3. The club head 32 shown here aligned with the cup profile 20 and the ball profile 22 is unique as compared to the prior art because the distance between the first and second alignment marks shown here as distance 48 is actually the diameter of the cup profile 20. This is standardized at 4¼ inches. The third and fourth alignment marks 46C and 46D are separated by a distance that is somewhat less than the diameter of the ball profile 22. This distance is labeled as distance 50.

By locating the alignment marks 46A and 46B at exactly the width of the cup diameter 48, the putter of the present invention provides the golfer with a very accurate representation of how relatively large the cup is as compared to the ball. It would be expected that conveying this information to the golfer will inspire confidence in the golfer. Furthermore, the golfer can use the center alignment mark 46E as well as the first and second alignment marks 46A and 46B to align not only the center of the cup, but also to the two sides of the cup. If we now turn to FIG. 5, we can see what the device looks like from its front.

Figure 5:
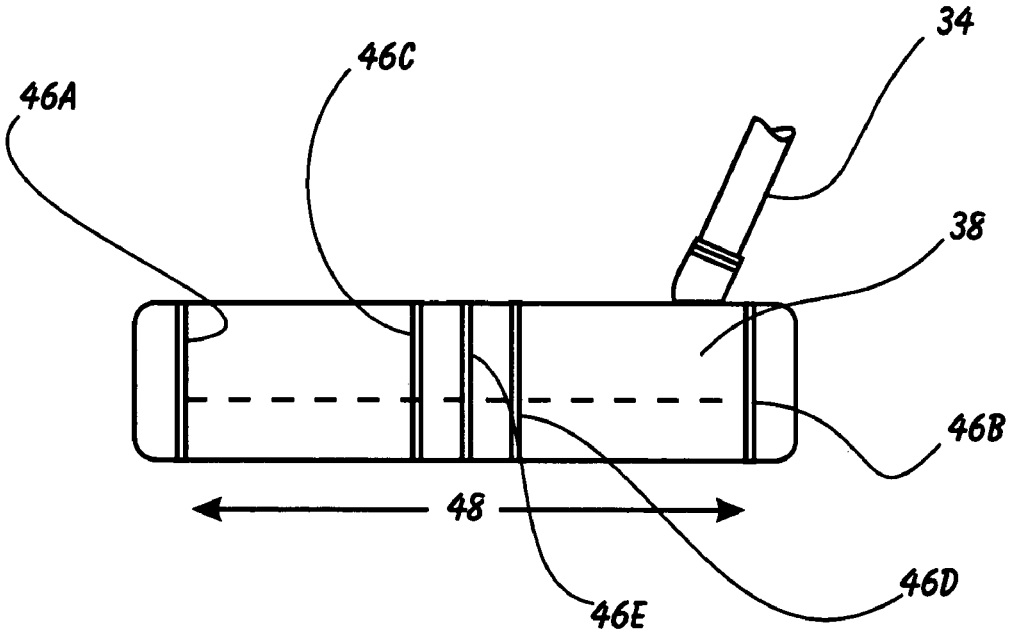
FIG. 5 is a front view of the putter of FIGS. 3 and 4.

FIG. 5 is a front view of the putter of FIGS. 3 and 4. As shown here, the alignment marks 46 all extend for the entire height of the face 38. As discussed above, one or more of these alignment marks 46 may only be depicted or inscribed on the top surface and not be inscribed or depicted on the face.

Figure 6:
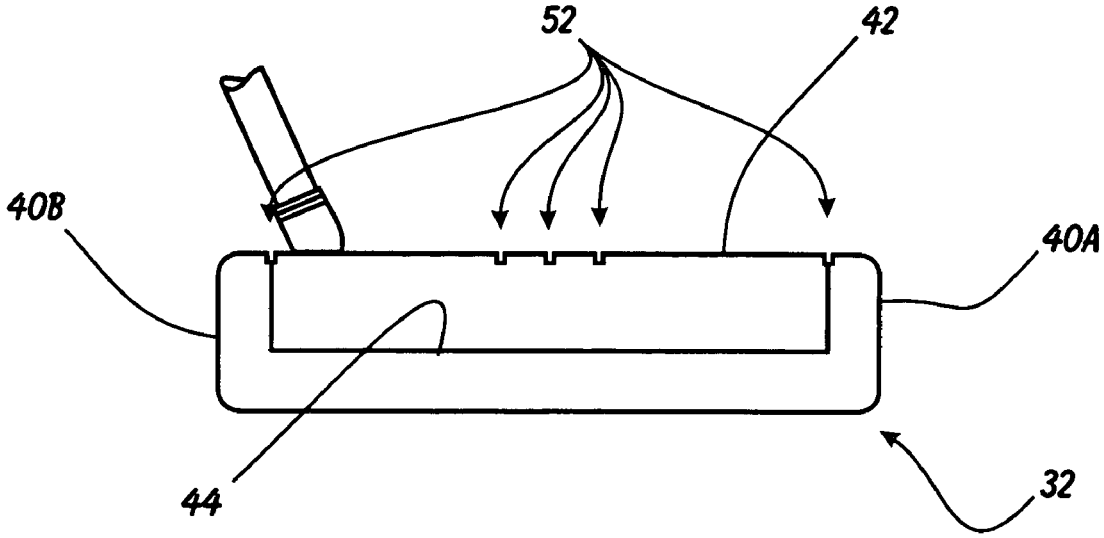
FIG. 6 is a back view of the putter of FIGS. 3–5.

FIG. 6 is a back view of the putter of FIGS. 3–5. FIG. 6 shows that the heel 44 is actually a recessed portion that is not co-planer with the top surface 42; essentially what is left is a cutout section between the first and second end 40A and 40B so that the head 32 is lighter particularly at the rear of the club. It has been determined that having a lighter rear portion of the club head 32 provides the golfer with more control at the face of the club. In the version depicted in FIG. 6, the alignment marks are provided with grooves 52 cut into the top surface 42 of the club head 32. Cutting grooves in the head 32 not only provides aesthetically superior alignment marks, but also extended durability and the golfer's ability to see the alignment marks.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A putter, comprising:

an elongated shaft having a handle end and an opposing head end;

a head comprising a front face in a transverse vertical spacial plane, and a top surface in a transverse horizontal spacial plane, said top surface displaying first, second, third, fourth and center alignment marks perpendicular to said transverse spacial plane, said first and second alignment marks in spaced arrangement at a distance of the diameter of a conventional golf hole cup, and said third and fourth alignment marks in spaced relation at a relative distance of 1.68 inches, said center alignment mark located centered between said first and second and said third and fourth alignment marks; and a shaft socket associated with said head for receiving said head end.

2. The putter of claim 1, wherein said head further comprises first, second, third, fourth and center vertical alignment marks inscribed on said face in alignment with said first, second, third, fourth and center alignment marks, respectively.

3. A head for a golf club device, comprising:

a substantially planar face, said face oriented in a first spacial plane;

a top surface perpendicular oriented in a second spacial plane perpendicular to said first spacial plane;

a first substantially linear alignment mark inscribed on said head perpendicular to said first spacial plane;

a second substantially linear alignment mark inscribed on said head perpendicular to said first spacial plane, said second mark parallel to said first mark at a distance of the diameter of a conventional golf hole cup from said first mark;

a center alignment mark inscribed on said head perpendicular to said first spacial plane, said center alignment mark parallel to said first and second marks and centered between said first and second marks; and third and fourth substantially linear alignment marks inscribed on said head perpendicular to said first spacial plane in spaced relation and separated by a distance of 1.68 inches, said third and fourth alignment marks cooperating with said center alignment mark such that said center alignment mark defines the center of said distance between said third and fourth alignment marks.

4. The head of claim 3 further comprising first, second, third, fourth and center vertical alignment marks inscribed on said face in alignment with said first, second, third, fourth and center alignment marks, respectively.

5. A putter head, comprising:

a front, a back, a top, a bottom, a first side and a second side;

said front defined by a substantially planar face oriented in a first spacial plane;

said top defined by a top surface in a second spacial plane, said top surface meeting said face at a front edge, said top further defined by a heel surface, said heel surface being lower than said top surface, said heel surface commencing from a point in spaced relation to said front and terminating at said back;

a first alignment mark displayed on said top surface substantially adjacent to said first side and extending substantially from said front to said back;

a second alignment mark displayed on said top surface substantially adjacent to said second side, in substantially parallel alignment with said first alignment mark at a distance of at least four and one-quarter inches from said first alignment mark, and extending substantially from said front to said back;

a center alignment mark displayed on said top surface intermediate said first and second alignment marks and extending substantially from said front to said commencement point of said heel surface; and third and fourth alignment marks displayed on said top surface in spaced relation at a distance of 1.68 inches, said third and fourth alignment marks centered on said center alignment mark, and both extending substantially from said front to said commencement point of said heel surface.

6. The head of claim 5, wherein said top surface extends from said first side to said second side and from said face to said back adjacent to said first and second side; and said heel surface extends from said back partially to said front and partially to said first and second side.

7. The head of claim 6 further comprising said third and fourth alignment marks inscribed on said top surface and parallel to said first, second and center alignment marks.

8. The head of claim 7 further comprising first, second, third, fourth and center vertical alignment marks inscribed on said face in alignment with said first, second, third, fourth and center alignment marks, respectively.

9. The head of claim 8, wherein said top surface alignment marks comprise grooves recessed into said top surface.

10. The head of claim 9, wherein said face alignment marks comprise grooves recessed into said face.

11. The head of claim 10, wherein said face alignment marks comprise grooves recessed into said face.

12. The head of claim 5, wherein said first and second alignment marks comprise grooves recessed into said top surface.

13. The head of claim 8, wherein said top surface alignment marks comprise grooves recessed into said top surface.

* * * * *